US011788394B2

(12) United States Patent
Mehrvand et al.

(10) Patent No.: US 11,788,394 B2
(45) Date of Patent: Oct. 17, 2023

(54) SYSTEMS AND METHODS FOR DEPLOYMENT OF ELECTRIC-BASED FRACTURING TOOLS IN VERTICAL WELLS

(71) Applicant: Eden GeoPower, Inc., Somerville, MA (US)

(72) Inventors: Mehrdad Mehrvand, Somerville, MA (US); Ammar Alali, Somerville, MA (US)

(73) Assignee: Eden GeoPower, Inc., Somerville, MA (US)

( * ) Notice: Subject to any disclaimer, the term of this patent is extended or adjusted under 35 U.S.C. 154(b) by 0 days.

(21) Appl. No.: 17/376,842

(22) Filed: Jul. 15, 2021

(65) Prior Publication Data

US 2023/0020716 A1 Jan. 19, 2023

(51) Int. Cl.

| | |
|---|---|
| ***E21B 43/26*** | (2006.01) |
| ***E21B 36/04*** | (2006.01) |
| ***E21B 43/24*** | (2006.01) |
| *E21B 33/16* | (2006.01) |

(52) U.S. Cl.
CPC ..... *E21B 43/26* (2013.01); *E21B 43/2401* (2013.01); *E21B 33/16* (2013.01)

(58) Field of Classification Search
CPC ..... E21B 43/26; E21B 47/12; E21B 43/267; E21B 33/124; E21B 33/12
See application file for complete search history.

(56) References Cited

U.S. PATENT DOCUMENTS

| | | | |
|---|---|---|---|
| 4,567,945 | A | 2/1986 | Segalman |
| 5,620,049 | A | 4/1997 | Gipson et al. |
| 9,243,487 | B2 | 1/2016 | Geilikman et al. |
| 9,890,627 | B2 | 2/2018 | Kasevich et al. |
| 11,091,991 | B1 | 8/2021 | Mehrvand et al. |

(Continued)

FOREIGN PATENT DOCUMENTS

| | | | | |
|---|---|---|---|---|
| CA | 2870984 A1 * | 10/2013 | ..... | E21B 17/206 |
| WO | WO 2013/178826 A1 | 12/2013 | | |

OTHER PUBLICATIONS

International Search Report and Written Opinion for International Application No. PCT/US2022/028932, dated Sep. 24, 2022.

*Primary Examiner* — Zakiya W Bates
(74) *Attorney, Agent, or Firm* — Wolf, Greenfield & Sacks, P.C.

(57) ABSTRACT

Systems and methods for deployment of electric-based fracturing tools in vertical wells are disclosed. A method of electric-based fracturing may include lowering an electrical stimulation tool into a wellbore using a drill pipe and isolating a lower portion of the wellbore that is downhole from an upper portion of the wellbore. The electrical stimulation tool may be disposed in the lower portion of the wellbore. A system for electric-based fracturing may include an isolation mechanism and an electrical stimulation tool. The isolation mechanism may be configured to expand from a retracted configuration spaced from an interior surface of a wellbore to an expanded configuration in contact with the inner surface of the wellbore. The electrical stimulation tool may be operatively coupled with the isolation mechanism and may be configured to be disposed distally relative to the isolation mechanism when positioned in the wellbore.

9 Claims, 5 Drawing Sheets

(56) References Cited

U.S. PATENT DOCUMENTS

| | | | |
|---|---|---|---|
| 2014/0299312 | A1 | 10/2014 | Morys |
| 2015/0167439 | A1 | 6/2015 | Kasevich et al. |
| 2016/0201425 | A1 | 7/2016 | Walton et al. |
| 2017/0321548 | A1 | 11/2017 | Enkababian et al. |
| 2018/0291713 | A1 | 10/2018 | Jeanson |

* cited by examiner

SYSTEMS AND METHODS FOR DEPLOYMENT OF ELECTRIC-BASED FRACTURING TOOLS IN VERTICAL WELLS

GOVERNMENT LICENSE RIGHTS

This invention was made with government support under the Small Business Innovation and Research project number 1951212 awarded by the National Science Foundation. The government has certain rights in the invention.

FIELD

Disclosed embodiments are related to electric-based fracturing.

BACKGROUND

Oil and gas are expected to supply more than 50% of total energy consumed worldwide by 2040, and geothermal may meet 3-5% of global demand by 2050. Well stimulation or fracturing has become commonplace in many new well drilling and development processes. Hydraulic fracturing, the most commonly used fracturing method over the last two decades, involves injecting a mixture of water, sand, and chemicals under high pressure into a bedrock formation through the well. This process is intended to create new fractures in the formation, as well as increase the size, extent, and connectivity of existing fractures. Increasing the number, size, or connectivity of fractures may increase the flow of oil and/or gas from petroleum-bearing rock formations to a well, from which the oil and/or gas may be extracted.

SUMMARY

In some embodiments, a method of electric-based fracturing includes lowering an electrical stimulation tool into a wellbore using a drill pipe and isolating a lower portion of the wellbore that is downhole from an upper portion of the wellbore. The electrical stimulation tool is disposed in the lower portion of the wellbore.

In some embodiments, a system for electric-based fracturing includes an isolation mechanism and an electrical stimulation tool. The isolation mechanism is configured to expand from a retracted configuration spaced from an interior surface of a wellbore to an expanded configuration in contact with the inner surface of the wellbore. The electrical stimulation tool is operatively coupled with the isolation mechanism and configured to be disposed distally relative to the isolation mechanism when positioned in the wellbore.

In some embodiments, a system for electric-based fracturing includes a power source, a high voltage cable comprising first, second, and third cable segments, a cable dispenser configured to dispense at least a portion of the second cable segment, an electrical stimulation tool, and connectors. A proximal connector is configured to operatively couple the power source and a proximal portion of the first cable segment. A first intermediate connector is configured to operatively couple a distal portion of the first cable segment and a proximal portion of the second cable segment. A second intermediate connector is configured to operatively couple a distal portion of the second cable segment and a proximal portion of the third cable segment. A distal connector is configured to operatively couple a distal portion of the third cable segment and the electrical stimulation tool. At least a portion of the second cable segment is disposed on the cable dispenser. The first intermediate connector is configured to be selectively connected and disconnected while the second cable segment is supported on the cable dispenser.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
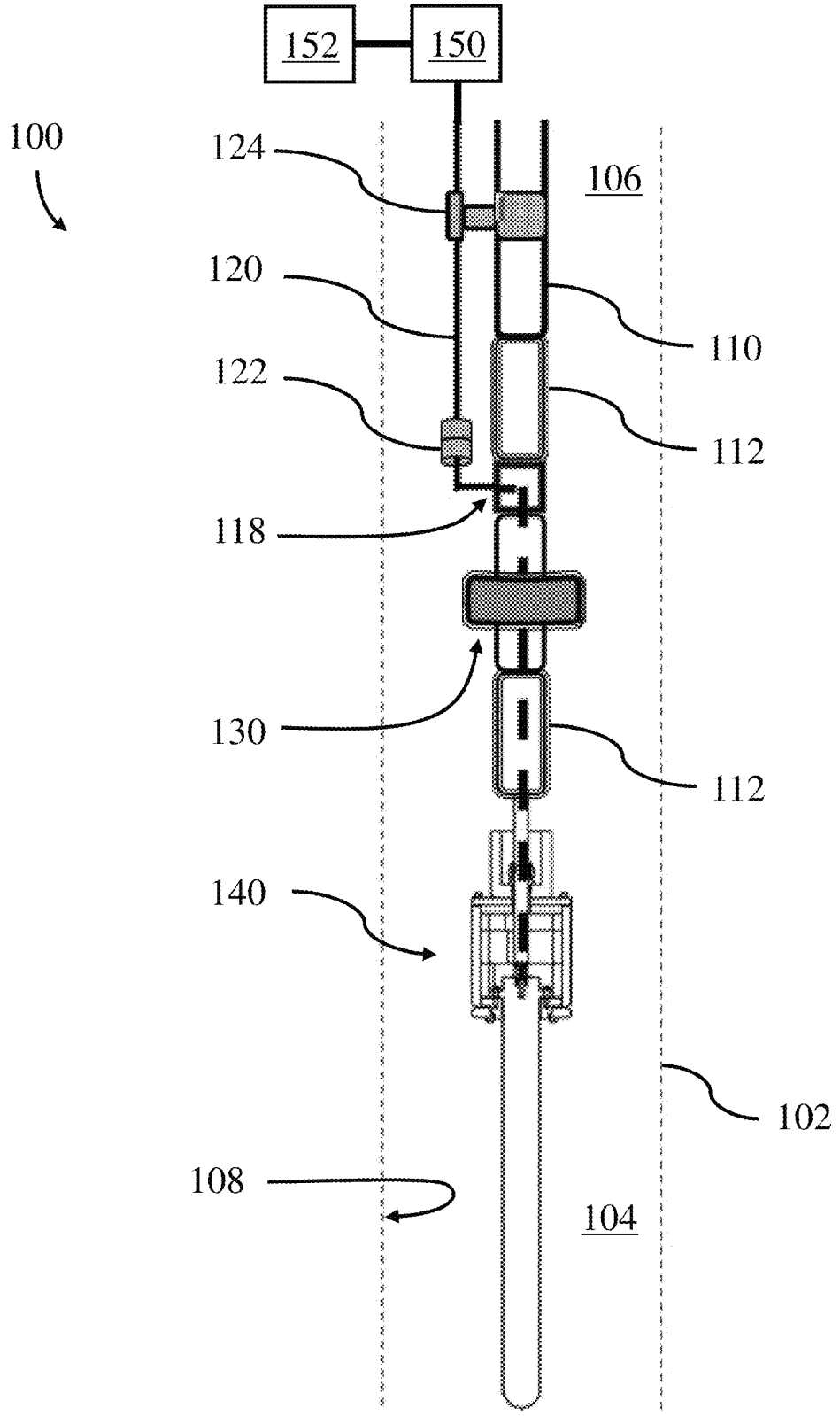
FIG. 1A depicts one embodiment of a downhole portion of an electric-based fracturing tool deployment system with an isolation mechanism in a retracted configuration.

In response to the increasing concerns about environmental issues of hydraulic fracturing (e.g., large water consumption, underground water contamination, air pollution, waste production) as well as its high operational costs, electric-based fracturing methods have been developed in recent years. These methods do not rely on pumping high-pressure water and/or injecting chemicals into a well, and accordingly do not suffer the environmental consequences associated with hydraulic fracturing. Instead, electric-based fracturing methods use an electrical stimulation tool within a well to convert electric energy into heat, which is subsequently transferred to the rock formation surrounding the well. The generated heat may induce fractures in the formation, and may induce changes in petrophysical properties of the geofluid and/or rock through a set of complex multiphysics phenomena.

Many electric-based fracturing methods are currently being investigated at the level of preliminary research, and a limited number of systems have been taken as far as a proof-of-concept pilot system. However, there are currently few (if any) electric-based fracturing methods or systems that have been tested extensively in the field. Electric-based fracturing methods have yet to be adapted to existing, real-world well operations and accepted in the petroleum industry as standard methods. With no standardized electric-based fracturing methods or systems, there is similarly no standardized way to deploy electric-based fracturing tools (e.g., electrical stimulation tools) downhole. Some prior electric-based fracturing systems attempt to deploy electric-based fracturing tools downhole by retrofitting existing hydraulic fracturing infrastructure or repurposing standard hydraulic fracturing equipment. However, these systems are often inefficient and prone to failure, as the tools and equipment are used in a manner for which they were not designed. Other prior electric-based fracturing systems include specialized equipment designed to deploy a particular set of tools. Such narrowly focused solutions may be appropriate for their tailored application, but cannot be used more broadly. As such, the Inventors have recognized a need for equipment that can be used to easily and reliably deploy a diverse array of electric-based fracturing tools.

In view of the above, the inventors have recognized and appreciated the benefits of deployment systems for electric-based fracturing tools in wells, including vertical wells for example, that can accommodate different downhole tools and enable the accurate and reliable execution of electric-based fracturing operations. Such a deployment system may be configured to provide both mechanical and electrical connection between surface equipment and a downhole electric stimulation tool. In some embodiments, a deployment system may structurally support the weight of the electrical stimulation tool, as well as the weight of the deployment system itself. Electrically, the deployment system may deliver electric power from the surface equipment to the electrical stimulation tool, and enable the tool to operate in the harsh downhole environment (high pressure, high temperature, harsh chemicals). In some embodiments, a deployment system may feature a modular design such that individual components may be easily assembled and/or disassembled, simplifying deployment operations, cleaning, and/or repair.

Beyond simply providing mechanical and/or electrical connections to a downhole tool (e.g., an electrical stimulation tool), an electric-based fracturing deployment system may provide additional functions. Given the harsh downhole environment during electric-based fracturing (e.g., high pressure, high temperature, chemicals, high power electricity, significant space constraints, as well as other considerations), the inventors have recognized and appreciated the benefits of isolating a first downhole portion of a borehole in which the electric fracturing is performed from a second portion of the borehole located above the first downhole portion as well as from equipment and/or personnel on the surface. Accordingly, as will be explained below, an electric-based fracturing system may include an isolation mechanism configured to physically and/or electrically isolate a lower portion of a well from an upper portion of the well. Such an isolation mechanism may prevent unwanted flow of electricity (e.g., shorts) and/or material (e.g., vapor, brine, or mud) from the lower portion of the well up to the upper portion of the well (or to the surface). As such, an isolation mechanism may improve system safety and provide a more efficient fracturing operation.

Generally, an electric-based fracturing system may include a power source and a downhole tool. The downhole tool may include any suitable electrode assembly capable of providing any suitable electric-based fracturing process. For example, a downhole tool may include an electrical stimulation or fracturing tool. The power source may be configured to provide power to the electrical stimulation tool, and the electrical stimulation tool may be configured to transfer the electrical power to a rock formation within a well and reservoir. In some embodiments, the power source may be removed from the electrical stimulation tool. For example, the power source may be disposed on the surface, and the electric-based fracturing system may include connections (e.g., mechanical connections, electrical connections) extending between the power source and the electrical stimulation tool. As will be explained in greater detail below, depending on the application, one or more mechanical connections extending between the power source and the electrical stimulation tool may include a drill string corresponding to multiple connected pipes connected to one another, and one or more electrical connections extending between the power source and the electrical stimulation tool may include a high voltage cable. However, it should be understood that any appropriate mechanical and/or electrical connection extending from a surface to the downhole tool may be used as the disclosure is not so limited.

As described above, an electric-based fracturing system may include an isolation mechanism. An isolation mechanism may be configured to be inserted into a well in a retracted configuration in which the isolation mechanism is spaced from an inner surface of the well. Upon activation, the isolation mechanism may be configured to expand to an expanded configuration to contact and apply a sealing pressure to an inner surface of the well. As expanded on further below, the isolation mechanism may conform to a size and shape of the inner surface of the well in the expanded configuration to form the desired seal. Thus, in the expanded configuration, the isolation mechanism may isolate a region of the well that is below, or downhole from, the isolation mechanism from a region of the well that is above, or uphole from, the isolation mechanism. In some embodiments, a downhole tool, such as an electrical stimulation tool, may be disposed distally relative to the isolation mechanism such that the tool is located in the isolated downhole portion of the well below the isolation mechanism. Thus, the isolation mechanism may isolate an operational zone of the well (e.g., a zone in which the electrical stimulation tool is operating) from a remainder of the well.

Depending on the application, an isolation mechanism may be configured to provide both electrical and mechanical isolation. Electrical isolation may be beneficial in isolating personnel and equipment on the surface from the operational zone. In some embodiments, an isolation mechanism is made of non-conducting material. Additionally, an isolation mechanism may be associated with a non-conductive portion of a drill string (explained in greater detail below). For example, an isolation mechanism may be coupled to a central portion of a non-conductive portion of a drill pipe, such that non-conductive tubing (of the drill pipe) extends from either side of the isolation mechanism.

In addition to electrical isolation, an isolation mechanism may provide mechanical isolation. In some embodiments, an isolation mechanism may provide a seal against physical contamination from the operational zone into an upper region of the well (or the surface). For example, an isolation mechanism may prevent brine or other liquid from entering into a region of the well above the isolation mechanism by providing a physical barrier between the regions of the well on opposing sides of the isolation mechanism.

In some embodiments, an isolation mechanism may be designed such that, in a retracted configuration, the size of the isolation mechanism is less than the size of the wellbore. For example, in a retracted configuration, a transverse dimension (e.g., a width or diameter) of the isolation mechanism may be less than a corresponding transverse dimension of the wellbore such that the isolation mechanism is able to be freely displaced in an axial direction relative to the wellbore. However, after the isolation mechanism is positioned at a desired location, the isolation mechanism may be expanded to contact an inner surface of the well. For example, a radial dimension of the isolation mechanism relative to a longitudinal axis of the wellbore may be increased such that the transverse dimension of the isolation mechanism may be increased, and in some such embodiments, may be approximately equal to a transverse dimension of the wellbore. That is, in an expanded configuration, the isolation mechanism may form a press fit with the wellbore. In some embodiments, a wellbore may have a diameter greater than or equal to 1 inch, 2 inches, 3 inches, 4 inches, 5 inches, 6 inches, 7 inches, 8 inches, or 9 inches. In some embodiments, a wellbore may have a diameter less than or equal to 10 inches, 9 inches, 8 inches, 7 inches, 6 inches, 5 inches, 4 inches, 3 inches, or 2 inches. For example, a wellbore may have a diameter of five inches. Accordingly, an isolation mechanism may form a slip fit with a five-inch (internal) diameter tube in a retracted configuration, and may have a diameter of less than 5 inches (e.g., 4 inches, 3 inches, 2 inches, or 1 inch) in the retracted configuration. Regardless of the specific size, the isolation mechanism may form a press fit with an internal surface of the wellbore in an expanded configuration, and may be configured to expand to a diameter greater than a size of the corresponding well bore if allowed to expand free of any constraints (e.g., if expanded outside of a tube) such that the isolation mechanism applies an outward radially directed force normal to the internal surface of the wellbore. Of course, it should be understood that the current disclosure is not limited to any particular size wellbore, and the disclosed systems may be used with wellbores both larger and smaller than those noted above.

It should be appreciated that the present disclosure is not limited in regard to how an isolation mechanism is transitioned between a retracted and expanded configuration within a wellbore. In some embodiments, the isolation mechanism may be deployed via inflation. For example, the isolation mechanism may be configured to inflate when a bladder or a membrane of the isolation mechanism is hydraulically and/or pneumatically pressurized. As the bladder is pressurized, the isolation mechanism may expand to contact an inner surface of the well. Through inflation, the isolation mechanism may accommodate the geometry of the inner surface of the well, and may create a conformal seal with the well. In some embodiments, a bladder of an isolation mechanism may include a rubber membrane reinforced with polyester fabric, Kevlar (from DuPont), steel, or any other suitable high-strength reinforcing material. In some embodiments, an isolation mechanism may include a packer head constructed of plated steel or aluminum and/or a shaft constructed of stainless steel and/or aluminum. In some embodiments, an isolation mechanism may experience pressures of up to 10,000 psi, and may be associated with a differential pressure rating of up to 4000 psi, which may be associated with a force of up to 25,000 kN exerted on the wellbore casing Alternatively, in other embodiments, an isolation mechanism may be articulated, and may be transitioned between a retracted and expanded configuration by adjusting one or more arms of an isolation mechanism. For example, an isolation mechanism may include one or more arms (e.g., elongate bodies, or rigid links) pivotably coupled to a drill pipe, or other supporting structure, at one end. In one such embodiment, a plurality of arms may be connected to the drill pipe at different locations around a perimeter of the drill pipe such that the arms extend out from the pipe in different directions during operation. In either case, in a retracted configuration of the isolation mechanism, each arm may be configured to be oriented in a retracted configuration relative to the drill pipe. For example, a longitudinal axis of each arm may be substantially parallel to a length of the drill pipe. Upon activation, each arm may pivot about a joint coupling the arm to the drill pipe. In this expanded configuration, a longitudinal axis of each arm may be angled relative to a length of the drill pipe such that the arms extend radially outward from a section of a drill pipe to which the arms are operatively coupled. As will be appreciated by one of skill in the art, an articulated isolation mechanism may include any suitable number and/or arrangement of linkages, biasing springs, latches, or actuators, as the present disclosure is not so limited. For example, a torsional spring may be configured to bias an arm of an articulated isolation mechanism toward its retracted configuration, and a rotary actuator may be configured to drive the arm toward its expanded configuration.

In some embodiments, it may be desirable to withdraw an isolation mechanism and associated downhole tool after an operation has been completed. Generally, withdrawal of an isolation mechanism may include reversing the process of deployment by transitioning the device from the expanded configuration to the retracted configuration. This may be accomplished in a number of different ways based on the specific structure used to provide the desired expansion and retraction. For example, if an isolation mechanism is deployed (e.g., from a retracted configuration to an expanded configuration) via inflation of a bladder via a pressurized fluid (e.g., a hydraulic fluid, or other fluid, capable of withstanding the operating environment) that is pumped into the bladder, the isolation mechanism may be withdrawn via deflation where the fluid is removed from the bladder to reduce a volume of the bladder. As another example, if an isolation mechanism is deployed by rotating one or more arms about corresponding joints in a first direction, the isolation mechanism may be withdrawn by rotating the one or more arms about the corresponding joints in a second direction opposite the first direction to retract the arms, thereby reducing a transverse dimension of the isolation mechanism.

In some embodiments, an isolation mechanism may not be withdrawn by reversing the process of deployment. For example, if an isolation mechanism is an inflatable isolation mechanism, a bladder of the inflated isolation mechanism may be popped or ruptured as part of a removal process. To rupture a bladder, an actuated puncturing device (e.g., a linear actuator with pointed tip) may be adjusted to contact a surface of the bladder. Alternatively, the pressure within the bladder may be increased to a predetermined pressure at which the bladder is configured to burst.

As an alternative to the above, in some embodiments, an isolation mechanism may be degradable to facilitate its removal from a wellbore. For example, an isolation mechanism may include a degradable plastic that is configured to be degraded and/or dissolved after a predetermined period of time after the isolation mechanism is exposed to a downhole environment. For example, a degradable isolation mechanism may be configured to degrade after a few days in a downhole environment. A degradable isolation mechanism may be configured to degrade passively (e.g., through constant exposure to the harsh downhole environment) or actively (e.g., by means of a corrosive material actively applied to the isolation mechanism). Appropriate degradable materials that one or more components of an isolation mechanism may be made from may include polymers such as polyglycolic acid (PGA), though other appropriate materials may also be used as the disclosure is not so limited.

An isolation mechanism may be configured to withstand the harsh downhole environment for the duration of a fracturing operation. In some embodiments, an isolation mechanism may be configured to withstand a temperature of greater than or equal to 100° C., 200° C., 300° C., 400° C., or 500° C. In some embodiments, an isolation mechanism may be configured to withstand a temperature of less than or equal to 600° C., 500° C., 400° C., 300° C., or 200° C. In some embodiments, an isolation mechanism may be configured to withstand a pressure of greater than or equal to 1,000 pounds per square inch (psi), 2,000 psi, 3,000 psi, 5,000 psi, 10,000 psi, or 15,000 psi. In some embodiments, an isolation mechanism may be configured to withstand a pressure of less than or equal to 20,000 psi, 15,000 psi, 10,000 psi, 5,000 psi, 3,000 psi, or 2,000 psi. It should be appreciated that an isolation mechanism may be configured to withstand ranges and/or combinations of temperatures and pressures. For example, the isolation mechanism may be configured to withstand a temperature of greater than or equal to 100° C. and less than or equal to 400° C., and a pressure of greater than or equal to 2000 psi and less than or equal to 3000 psi. Of course, an isolation mechanism may be configured to withstand other combinations of temperature and pressure, and it should be appreciated that the present disclosure is not limited in this regard.

In some embodiments, an isolation mechanism may be configured to withstand (i.e. rated for operation with) a peak voltage applied to a surrounding formation of greater than or equal to 5 kilovolts (kV), 10 kV, 25 kV, 50 kV, or 100 kV without shorting across the isolation mechanism. In some embodiments, an isolation mechanism may be configured to withstand a peak voltage of less than or equal to 200 kV, 100 kV, 50 kV, 25 kV, or 10 kV without shorting across the isolation mechanism. In some embodiments, an isolation mechanism may be configured to withstand a peak current applied to a surrounding formation of greater than or equal to 10 amperes (A), 20 A, 50 A, 100 A, 250 A, or 500 A without shorting across the isolation mechanism. In some embodiments, an isolation mechanism may be configured to withstand a peak current of less than or equal to 1000 A, 500 A, 250 A, 100 A, 50 A, or 20 A without shorting across the isolation mechanism. However, voltage and current ranges both greater than and less than those noted above are also contemplated.

As described above, an electric-based fracturing system may include a drill string which may correspond to a plurality of connected drill pipes that extend from a surface of the wellbore to a position of the downhole tool. The overall drill string and individual drill pipes may include a hollow tube configured to enable the flow of liquid (e.g., a drilling fluid, a hydraulic fracturing fluid, a conductive fluid, a cooling fluid, and/or any other appropriate fluid). A drill pipe may also be configured to support the weight of an electrical stimulation tool within the well, as well as any supporting hardware and/or connections to the electrical stimulation tool (e.g., a high voltage cable). Furthermore, the drill pipe may be used to move, reposition, and/or reorient the electrical stimulation tool within the borehole of the well. For example, the electrical stimulation tool may be raised and/or lowered within a vertical well by adjusting the drill pipe. However, while in some embodiments a drill string may be used to position and support a downhole tool, embodiments in which other support structures (such as cables and/or any other appropriate structure) are used are also contemplated, as the disclosure is not limited in this fashion.

As described above, an electric-based fracturing system may include a high voltage cable. It should be appreciated that any cable configured to transmit electricity from a power source to an electrical stimulation tool may be used, as the present disclosure is not limited in this regard. In some embodiments, a high voltage cable may be rated to withstand voltages of greater than or equal to 10 kV, 25 kV, 50 kV, 75 kV, 100 kV, 150 kV, or 200 kV. In some embodiments, a high voltage cable may be rated to withstand voltages of less than or equal to 250 kV, 200 kV, 150 kV, 100 kV, 75 kV, 50 kV, or 25 kV. In some embodiments, a high voltage cable may be rated to withstand currents of greater than or equal to 10 A, 25 A, 50 A, 75 A, 100 A, 150 A, or 200 A. In some embodiments, a high voltage cable may be rated to withstand currents of less than or equal to 250 A, 200 A, 150 A, 100 A, 75 A, 50 A, or 25 A. In some embodiments, a high voltage cable may transmit kilowatts or megawatts of power. It should be appreciated that the voltage and current ranges described above may additionally apply to other electrical components within an electric-based fracturing system. For example, the voltage and current ranges described above may additionally apply to a power source, an electrode of a downhole tool, and related electrical components.

A high voltage cable may be any suitable diameter, as the present disclosure is not limited in this regard. In some embodiments, a high voltage cable may have a diameter greater than or equal to 0.1 inches, 0.25 inches, 0.5 inches, 0.75 inches, 1 inch, 2 inches, 3 inches, or 4 inches. In some embodiments, a high voltage cable may have a diameter less than or equal to 5 inches, 4 inches, 3 inches, 2 inches, 1 inch, 0.75 inches, 0.5 inches, or 0.25 inches. In some embodiments, an electric-based fracturing system may include a surface spool configured to manage the length of the high voltage cable, and to adjust a vertical position of an electrical stimulation tool within the well.

A high voltage cable may include multiple layers. For example, a high voltage cable may include a conductive core and any suitable number of insulative and/or protective layers. In some embodiments, a high voltage cable may include a bare copper core, a first semi-conductor Ethylene Propylene Rubber (EPR) layer, an EPR insulation layer, a second semi-conductor EPR layer, a copper shield layer, and a PVC jacket layer (for mechanical protection). It should be appreciated that other designs of high voltage cables with different numbers and/or arrangements of layers are contemplated, and that the present disclosure is not limited in this regard.

In some embodiments, a drill string may additionally be configured to constrain motion of a high voltage cable within a well. For example, a high voltage cable may extend into a well along the length of the drill string (e.g., parallel to the drill string), or other supporting structure, and may be at least partially constrained in position and/or orientation by the drill pipes of the drill string. For example, in some embodiments, at least a portion of the high voltage cable is connected to the drill string at spaced apart locations along a length of the drill string (e.g., using non-conductive tube clamps). In another embodiment, at least a portion of the high voltage cable may be disposed within and extend along an interior of the drill string, such that an inner surface of the hollow drill string constrains motion of the high voltage cable. For example, a high voltage cable may be arranged concentrically with the individual drill pipes of the drill string. In yet another embodiment, a combination of the above might be used. For example, a first portion of a high voltage cable may be located external to one or more drill pipes of a drill string. Similar to the above, this portion of the cable, for example, may be coupled to the drill pipe using one or more plastic clamps. Correspondingly, a second portion of the high voltage cable may be disposed internal to one or more drill pipes of the drill string. The high voltage cable may transition from an external configuration relative to an adjacent drill pipe to an internal configuration relative to the adjacent drill pipe (or vice versa) by passing through a port in the side of the drill pipe (such as a side entry sub). Such an embodiment is explained in greater detail below.

Drill pipes used in hydraulic fracturing are often made of metals selected for their high strength-to-weight ratios and relative low cost. However, metal drill pipes may be electrically conductive, which may pose challenges for electric-based fracturing systems and methods. In some embodiments of an electric-based fracturing system, one or more drill pipes of a drill string may be made from or include one or more non-conductive portions. For example, a drill string may include a non-conductive distal portion configured to electrically insulate a proximal portion of the drill string from the remainder of the system. A distal portion of a drill string may include one or more distal drill pipes of the drill string, or may include a portion (e.g., a distal portion) of a distal drill pipe of a drill string. A drill string with a non-conductive distal portion, which may correspond to a distal drill pipe or portion of a drill pipe, may protect a proximal portion of the drill string against electrical leakage from an operational region downhole (e.g., a region in which an electrical stimulation tool is operating), thereby reducing the risk of shorts and/or electrical hazards to equipment and/or personnel on the surface. The non-conductive distal portion of the drill string may be made from any suitable non-conductive material that is able to withstand the temperature and pressure of the downhole environment, and that is able to satisfy the relevant mechanical constraints (e.g., supporting the weight of the electrical stimulation tool). In some embodiments, the non-conductive distal portion of the drill string may be made from a polymer, such as polyphenylene sulfide. In some embodiments, the non-conductive distal portion of the drill string may have a resistivity of greater than or equal to $10^{14}$ ohm-cms, $10^{15}$ ohm-cms, $10^{16}$ ohm-cms, $10^{17}$ ohm-cms, or $10^{18}$ ohm-cms. In some embodiments, the non-conductive distal portion of the drill string may have a resistivity of less than or equal to $10^{19}$ ohm-cms, $10^{18}$ ohm-cms, $10^{17}$ ohm-cms, $10^{16}$ ohm-cms, or $10^{15}$ ohm-cms. However, it should be appreciated that other materials and other resistivities are contemplated, and that the present disclosure is not limited in regard to any particular material and/or resistivity of a non-conductive distal portion of a drill string.

As described above, a deployment system specifically intended for use with electric-based fracturing tools in vertical wells may have certain benefits relating to the execution of electric-based fracturing processes. Beyond facilitating the actual fracturing process itself, the inventors have additionally recognized and appreciated the benefits of a system that facilitates the deployment processes that precede the fracturing process. Specifically, the inventors have recognized and appreciated the benefits associated with a modular deployment system for electric-based fracturing tools and their associated methods. As will be explained in greater detail below, a modular deployment system may be associated with easier assembly and/or disassembly, as well as simpler cleaning, repair, and/or replacement of components. Furthermore, a modular deployment system may more readily accommodate disparate equipment and/or well configurations, as a modular deployment system may be reconfigurable to adapt to the demands of a specific operation.

In some embodiments, a system for electric-based fracturing may include a modular high voltage cable that includes multiple cable segments. As suggested above, a modular high voltage cable may be associated with certain benefits relating to assembly, disassembly, cleaning, repair, replacement, and reconfigurability. A modular high voltage cable may include any suitable number of cable segments and/or connectors. For example, a proximal connector may be configured to operatively couple a surface power source and a proximal portion of the high voltage cable. Similarly, a distal connector may be configured to operatively couple a distal portion of the high voltage cable and an electrical stimulation tool. Between the proximal and distal connectors, the high voltage cable may include any suitable number of cable segments and/or intermediate connectors as detailed further below. In some embodiments, a connector may include a plug configured to mate with a corresponding socket. For example, a first end of a first cable segment may include a plug, and a second end of a second cable segment may include a socket. When the plug is mated with the socket, an electrical connection may be formed between the first and second cable segments. In some embodiments, a connector may include strain relief, an insulating jacket, or another protective element. In some embodiments, a connector may include overmolding (e.g., the socket and/or the plug may be overmolded).

A modular high voltage cable with different cable segments may enable a more robust system, as different cable segments may be designed and engineered according to different specifications. The two end cable segments of a modular high voltage cable may facilitate the processes of connecting to the power source or the electrical stimulation tool, while the middle cable segment(s) may facilitate the process of adjusting a vertical position of the electrical stimulation tool in the well. As the end cable segments may be primarily act as extensions to the power source or the electrical stimulation tool and may not experience much motion and/or reconfiguration, the end cable segments may not need (for example) to have a small bend radius. As the middle cable segment(s) may be configured to coil around a cable dispenser (e.g., a spool), the middle cable segment(s) thus may be designed with a smaller bend radius.

In some embodiments, a high voltage cable includes a first cable segment, a second cable segment, and a third cable segment. The first cable segment may be associated with the surface equipment, and the third cable segment may be associated with the downhole equipment. The second cable segment may enable an electrical connection between the surface equipment and downhole equipment, and may enable adjustments to the relative position of the surface equipment and downhole equipment. Accordingly, the first and third cable segments may remain relatively static throughout a fracturing operation, while the second cable segment may be routinely adjusted. The first cable segment may be coupled to a surface power supply, and may be configured to remain above the surface. The second cable segment may run from the surface and down the well along a drill string of the system. As described above, the cable may be clamped to the drill string using a non-conductive tube clamp, or any other suitable clamp. Of the three cable segments, the second cable segment may be the longest. The third cable segment may be coupled to an electrical stimulation tool, and may primarily reside within an operational zone of the well. In some embodiments, the majority of the third cable segment may be internal to (e.g., disposed within) a drill string. For example, a proximal portion of the third cable segment may be external to a drill pipe, and may then enter the drill pipe through a port in the drill pipe, such as a side entry sub. That is, a drill pipe of the drill string may include a side entry sub through which the high voltage cable is configured to pass. Accordingly, the third cable segment may connect to the electrical stimulation tool from within the drill pipe. In some embodiments, a length of the third cable segment may be greater than 10 feet and may be less than 30 feet.

The cable segments may be coupled using connectors. Connectors may facilitate assembly and/or disassembly of a high voltage cable, as described above. Any suitable electrical cable connector configured to withstand the high temperature, high pressure downhole environment and rated for the voltage and current used in the high voltage cable (as described above) may be used, as the disclosure is not limited in this regard. In some embodiments, the connectors of an electric-based fracturing may be rated to operate in pressures of at least 5000 psi.

Continuing the above example of a high voltage cable with three cable segments, a proximal connector may be configured to operatively couple a surface power source and a proximal portion of the first cable segment. A first intermediate connector may be configured to operatively couple a distal portion of the first cable segment and a proximal portion of the second cable segment. A second intermediate connector may be configured to operatively couple a distal portion of the second cable segment and a proximal portion of the third cable segment. A distal connector may be configured to operatively couple a distal portion of the third cable segment and an electrical stimulation tool.

While an example is presented above with three cable segments and four connectors (i.e., a proximal connector, a distal connector, and two intermediate connectors), it should be appreciated that a modular high voltage cable may include any suitable number of cable segments and/or connectors, as the present disclosure is not limited in this regard.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 1B:
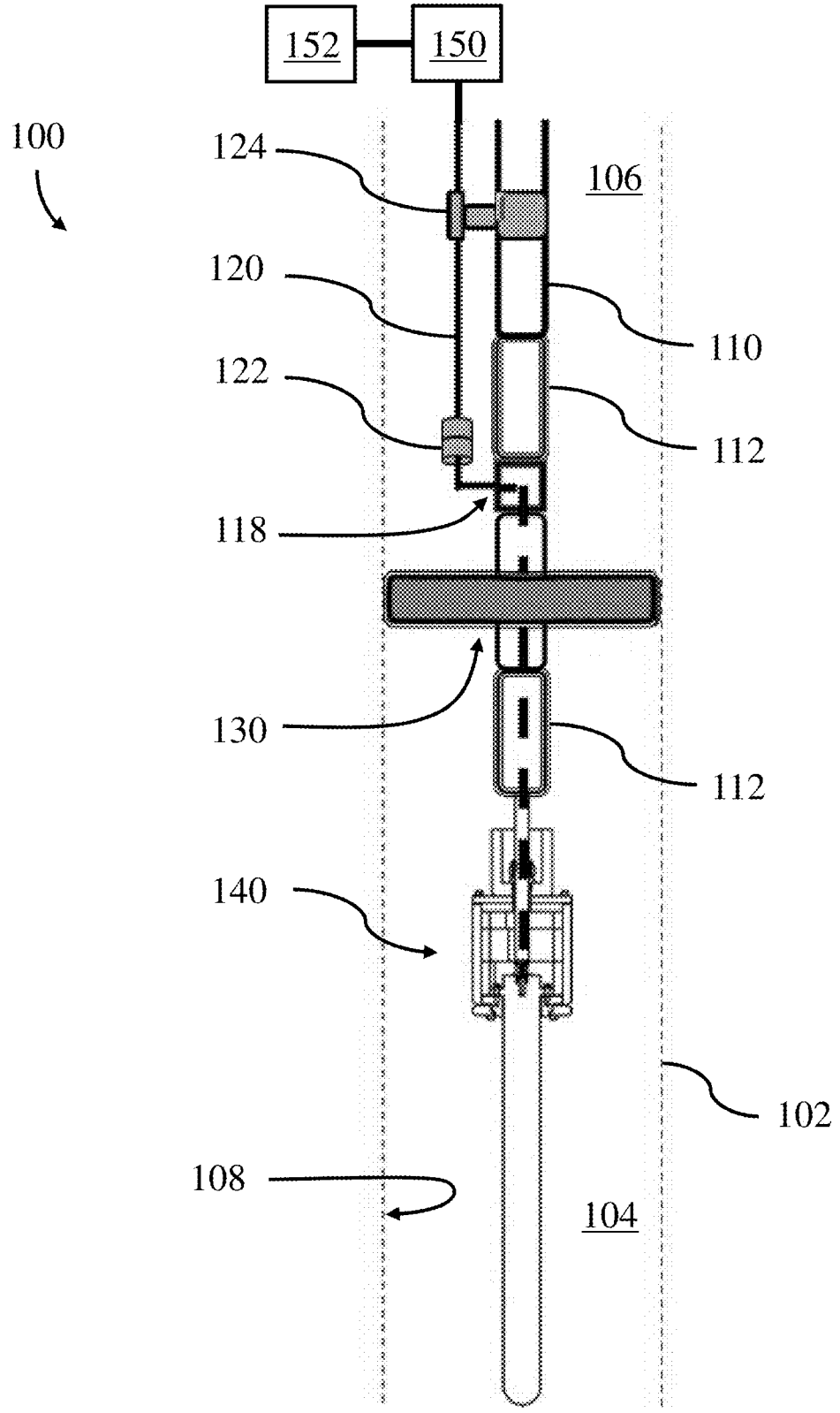
FIG. 1B depicts the downhole portion of the electric-based fracturing tool deployment system of FIG. 1A with the isolation mechanism in an expanded configuration.

FIGS. 1A-1B depict one embodiment of a downhole portion of a system 100 for deploying an electric-based fracturing tool, such as an electrical stimulation tool 140, within a well 102. The deployment system 100 includes a drill string corresponding to a plurality of serially connected drill pipes 110 disposed within the well 102. A high voltage cable 120 may be coupled to the electrical stimulation tool 140 and is configured to delivery electricity to the electrical stimulation tool 140 from a surface power source 150. The power source 150 may be operatively coupled to a processor 152 with associated memory. The processor may be configured to operate the isolation mechanism to transition between the retracted and expanded configuration and/or an operation of the power source for operating the electrical stimulation tool to apply a voltage to a surrounding formation relative to another electrode positioned in an adjacent well and/or on the surface. Of course, while a single processor is depicted and a specific downhole tool are illustrated in the figure, other processor configurations and downhole tools may be used. In either case, a first portion of the high voltage cable 120 may extend along an exterior of the drill pipes. To help constrain a location of the high voltage cable within the wellbore, the high voltage cable may be connected to the plurality of drill pipes at a plurality of spaced apart locations along a length of the serially connected drill pipes. For example, the high voltage cable may be clamped to a drill pipe 110 with one or more clamps 124, hooks, collars, or other appropriate type of connector capable of connecting the cable to an associated drill pipe or other structure. The high voltage cable 120 includes multiple cable segments that are coupled using connectors 122 (explained in greater detail below in reference to FIGS. 2 and 3). The high voltage cable 120 passes through a side entry sub 118 in the drill pipe 110, such that a distal portion of the high voltage cable 120 is disposed within the drill pipe 110.

The fracturing system 100 of FIGS. 1A-1B may additionally include an isolation mechanism 130. The isolation mechanism 130 is disposed on a non-conductive distal portion 112 of the drill pipe 110. The isolation mechanism is shown in a retracted configuration in FIG. 1A, and in an expanded configuration in FIG. 1B. In the retracted configuration of FIG. 1A, the isolation mechanism is spaced from an inner surface 108 of the well 102. When the isolation mechanism 130 is expanded from a retracted configuration into an expanded configuration (e.g., by hydraulic or pneumatic inflation), the isolation mechanism 130 contacts an inner surface 108 of the well 102 (as shown in FIG. 1B). In the expanded configuration, the isolation mechanism 130 isolates a lower portion 104 of the well 102 from an upper portion 106 of the well 102. As described above, the isolation mechanism 130 provides both electrical and physical isolation between the two portions of the well 102.

Figure 2:
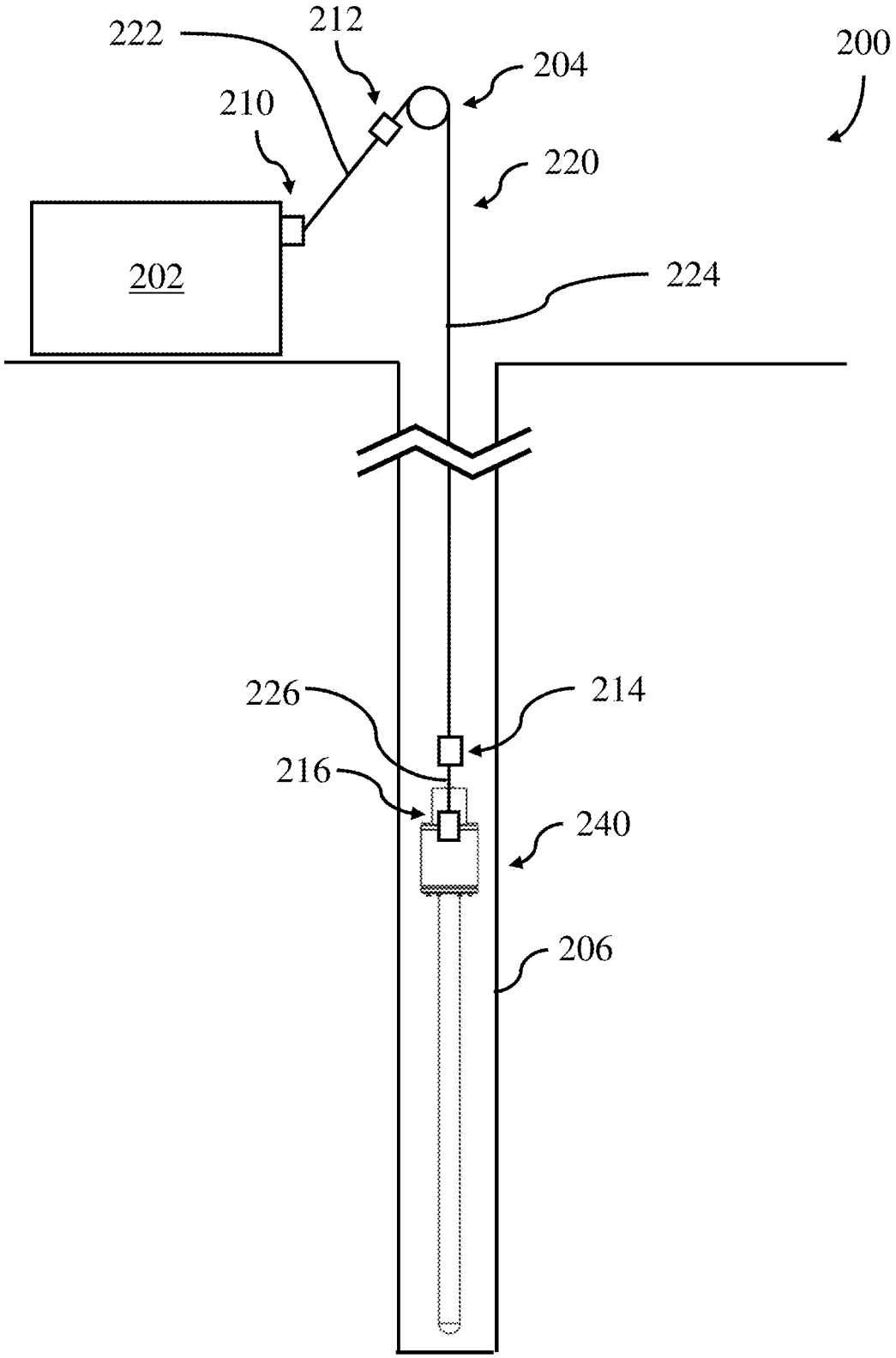
FIG. 2 depicts one embodiment of an electric-based fracturing tool deployment system.

FIG. 2 depicts one embodiment of a system 200 for deploying an electric-based fracturing tool, such as an electrical stimulation tool 240, within a well 206. The deployment system 200 includes a surface power source 202 and a high voltage cable 220, as well as a spool 204 is configured to adjust a vertical position of the electrical stimulation tool 240 within the well 206. A proximal connector 210 couples the surface power source 202 to a proximal portion of the high voltage cable 220. A distal connector 216 couples a distal portion of the high voltage cable 220 to the electrical stimulation tool 240.

In the embodiment of FIG. 2, the high voltage cable 220 is a modular high voltage cable with multiple segments. As described above, a modular high voltage cable may be associated with certain benefits relating to assembly, disassembly, cleaning, repair, replacement, and reconfigurability. Additionally, a modular high voltage cable configured to apply the voltages and currents disclosed herein may include cable segments individually tailored to specific operations and/or parameters enabling a more robust overall cable. The high voltage cable 220 includes a first cable segment 222, a second cable segment 224, and a third cable segment 226. The first cable segment 222 may be configured to remain above the surface. The second cable segment 224 may run from the surface and down the well 206 along a drill string of the system 200. Of the three cable segments, the second cable segment 224 may be the longest. The third cable segment 226 may be coupled to the electrical stimulation tool 240, and may primarily reside within an operational zone of the well. In some embodiments, the majority of the third cable segment 226 may be internal to (e.g., disposed within) a drill string. For example, a proximal portion of the third cable segment may be external to a drill pipe, and may then enter the drill pipe through a port in the drill pipe, such as a side entry sub (as shown in FIGS. 1A and 1B). That is, a drill pipe of the drill string may include a side entry sub through which the high voltage cable is configured to pass. Accordingly, the third cable segment may connect to the electrical stimulation tool from within the drill pipe. A first intermediate connector 212 couples a distal portion of the first cable segment 222 and a proximal portion of the second cable segment 224. A second intermediate connector 214 couples a distal portion of the second cable segment 224 and a proximal portion of the third cable segment 226.

Figure 3:
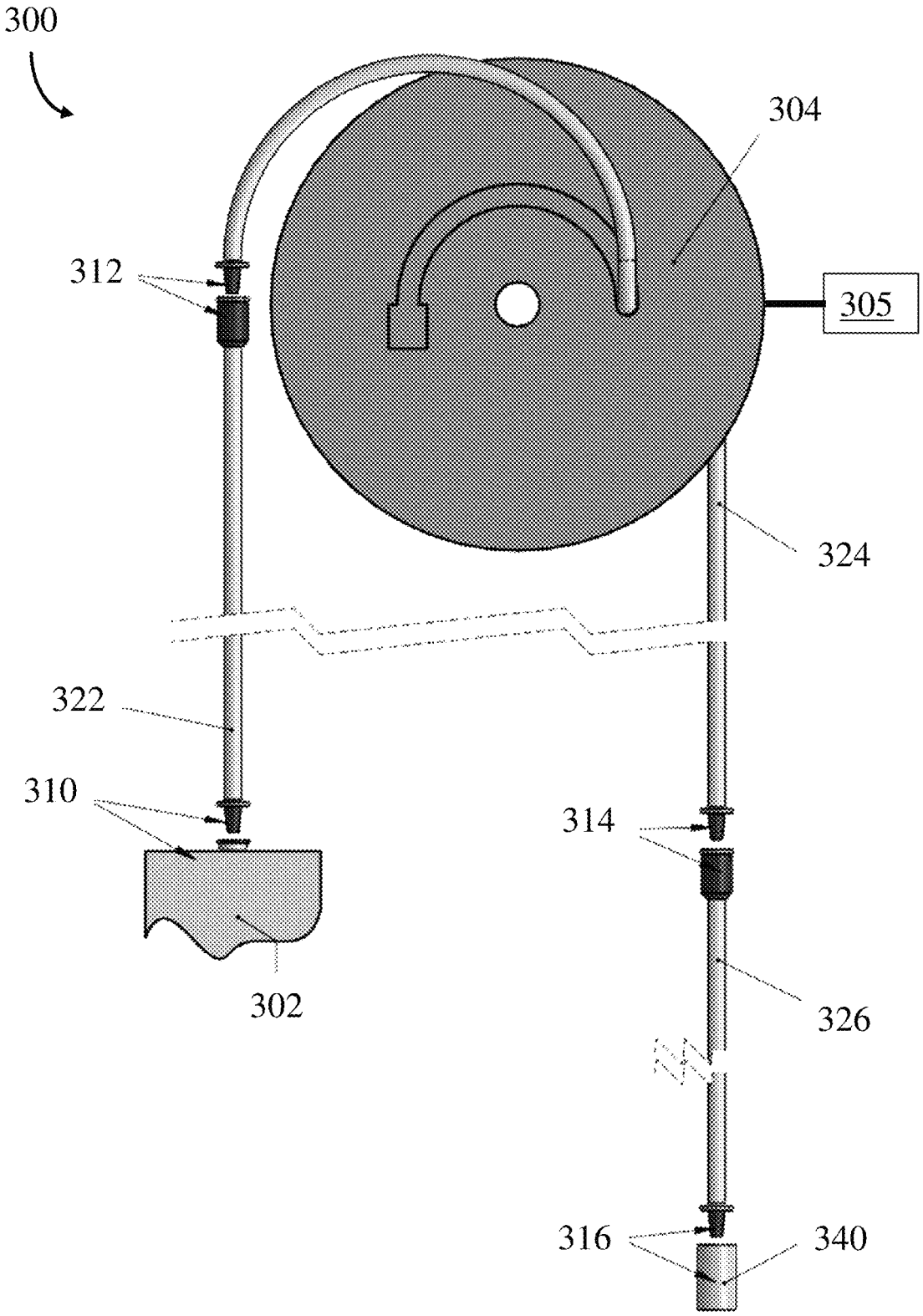
FIG. 3 depicts another embodiment of an electric-based fracturing tool deployment system.

FIG. 3 depicts another embodiment of an electric-based fracturing tool deployment system 300. The deployment system 300 includes an electrical stimulation tool 340 connected to a power source 302 by a high voltage cable that includes a first cable segment 322, a second cable segment 324, and a third cable segment 326. The dashed lines in the figure indicate that the cable segments may be any suitable length. A proximal connector 310 couples the power source 302 to a proximal portion of the first cable segment 322. A first intermediate connector 312 couples a distal portion of the first cable segment 322 and a proximal portion of the second cable segment 324. A second intermediate connector 314 couples a distal portion of the second cable segment 324 and a proximal portion of the third cable segment 326. A distal connector 216 couples a distal portion of the third cable segment 326 to the electrical stimulation tool 240.

The system 300 also includes a cable dispenser such as a rotatable spool 304. Typically, at least a portion of the second cable segment 324 is disposed on the spool 304, such that rotating the spool 304 either dispenses or retracts the second cable segment 324, thereby lowering or raising the electrical stimulation tool 340. The spool 304 may be coupled to an actuator 305 configured to rotate the spool 304. When the actuator 305 rotates the spool 304 in a first direction, a portion of the second cable segment 324 is unwound from the spool 304, and the electrical stimulation tool 340 is lowered farther into the well. When the actuator 305 rotates the spool 304 in a second direction opposite the first direction, the second cable segment 324 is wound further onto the spool 304, and the electrical stimulation tool 340 is raised. The first intermediate connector 312 may be accessible on a proximal side of the spool 304 (e.g., the first connection may be disposed between the spool and the power source), such that connections between the first and second cable segments 322 and 324 may be formed and/or broken regardless of the position of the spool 304 and/or the position of the electrical stimulation tool 340 within the well. Having a connection on the proximal side of the spool may facilitate repair and/or replacement of system components proximal to the spool (e.g., the first cable segment) without adjusting distal components of the system.

Figure 4A:
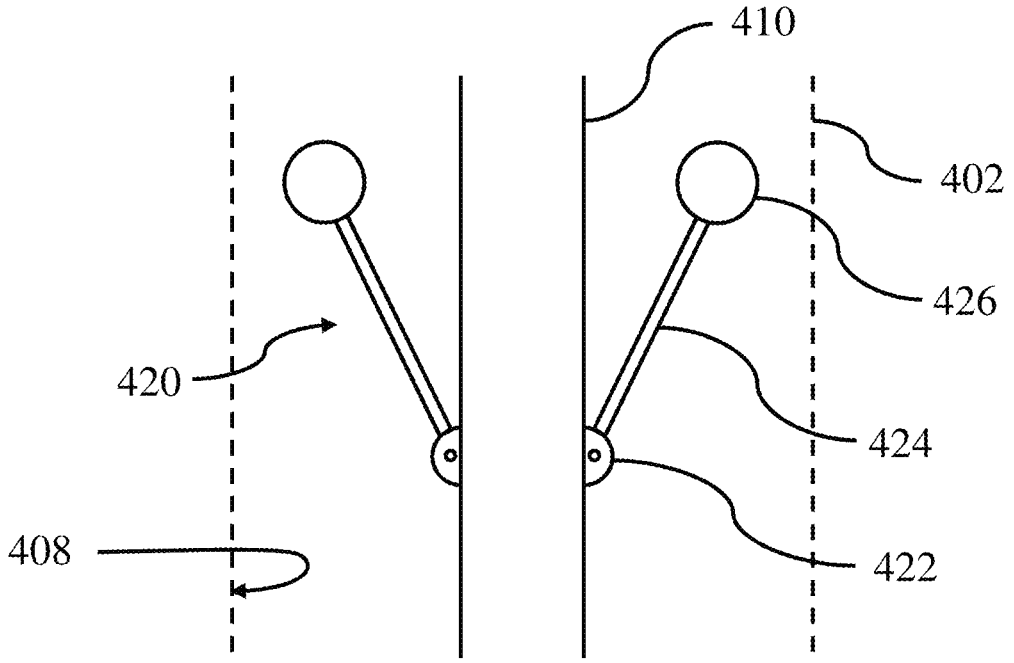
FIG. 4A depicts one embodiment of an articulated isolation mechanism in a retracted configuration.
Figure 4B:
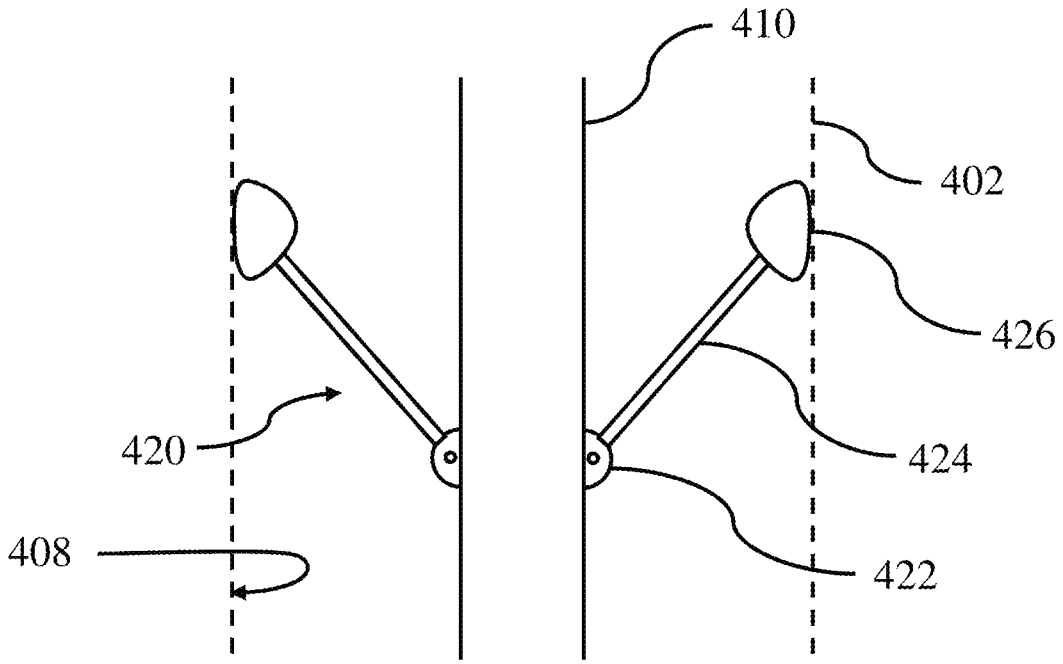
FIG. 4B depicts the articulated isolation mechanism of FIG. 4A in an expanded configuration.

FIGS. 4A-4B depict one embodiment of an articulated isolation mechanism 420 coupled to a portion of a drill string 410 of a drill pipe disposed within a well 402. FIG. 4A depicts the articulated isolation mechanism 420 in a retracted configuration, and FIG. 4B depicts the articulated isolation mechanism 420 in an expanded configuration. The articulated isolation mechanism 420 includes a plurality of arms 424 configured to rotate about respective joints 422. Each joint 422 may be associated with springs and/or actuators configured to bias and/or actively control an angular position of the associated arm 424. Each arm 424 may include a compliant portion 426 at its distal end. When the arms 424 are expanded (as in FIG. 4B), the compliant portions 426 of the arms 424 may deform upon contacting an inner surface 408 of the well 402.

Although not visible in the views of FIGS. 4A-4B, the arms 424 may be connected circumferentially so that the articulated isolation mechanism 420 forms a complete seal when in the expanded configuration. For example, the compliant portions 426 of the arms 424 may be formed as a single structure, such as a deformable (e.g., a radially expandable) toroidal structure. Adjacent arms 424 may be connected as well (e.g., using a flexible and/or elastic material). For example, if an articulated isolation mechanism includes four evenly spaced arms, the articulated isolation mechanism may include four membranes, each of which is connected to two adjacent arms. That is, each membrane may span (circumferentially) the 90° between the adjacent arms, and each membrane may span (radial) the full length of the arm. In some embodiments, the membranes may wrap around the compliant portion of the arm. Accordingly, in the expanded configuration of FIG. 4B, the articulated isolation mechanism 420 may take the shape of an inverted conical frustrum (e.g., a funnel), thereby forming a seal.

In some embodiments, a method of electric-based fracturing may include lowering an electrical stimulation tool into a well using a drill pipe, and isolating a lower portion of the well from an upper portion of the well. Isolating the lower portion of the well from the upper portion of the well may include deploying an isolation mechanism from a portion of the drill string, such as a distal most drill pipe, which may be non-conductive. As described above, it should be appreciated that the present disclosure is not limited in regard to how the isolation mechanism is deployed. In some embodiments, the isolation mechanism may be deployed via inflation. For example, a bladder of the isolation mechanism may be hydraulically inflated and/or pneumatically inflated such that the bladder makes a conformal seal with an interior surface of the wellbore. In some embodiments, an isolation mechanism may be deployed by expanding one or more arms of the isolation mechanism. After a fracturing operation is performed, a method of electric-based fracturing may include removing the isolation mechanism. In some embodiments, removing the isolation mechanism may include deflating the isolation mechanism (e.g., hydraulically or pneumatically). In some embodiments, removing the isolation may include degrading the isolation mechanism. After the isolation mechanism is removed, the method may include removing the electrical stimulation tool from the well.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

The above-described embodiments of the technology described herein can be implemented in any of numerous ways. For example, the embodiments may be implemented using hardware, software or a combination thereof. When implemented in software, the software code can be executed on any suitable processor or collection of processors, whether provided in a single computing device or distributed among multiple computing devices. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Further, it should be appreciated that a computing device may be embodied in any of a number of forms, such as a rack-mounted computer, a desktop computer, a laptop computer, or a tablet computer. Additionally, a computing device may be embedded in a device not generally regarded as a computing device but with suitable processing capabilities, including a Personal Digital Assistant (PDA), a smart phone, tablet, or any other suitable portable or fixed electronic device.

Also, a computing device may have one or more input and output devices. These devices can be used, among other things, to present a user interface. Examples of output devices that can be used to provide a user interface include display screens for visual presentation of output and speakers or other sound generating devices for audible presentation of output. Examples of input devices that can be used for a user interface include keyboards, individual buttons, and pointing devices, such as mice, touch pads, and digitizing tablets. As another example, a computing device may receive input information through speech recognition or in other audible format.

Such computing devices may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, RAM, ROM, EEPROM, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computing devices or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computing device or other processor to implement various aspects of the present disclosure as discussed above. Additionally, it should be appreciated that according to one aspect of this embodiment, one or more computer programs that when executed perform methods of the present disclosure need not reside on a single computing device or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

The embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

The invention claimed is:

1. A system for electric-based fracturing, the system comprising:

an isolation mechanism configured to expand from a retracted configuration spaced from an interior surface of a wellbore to an expanded configuration in contact with the inner surface of the wellbore;

an electrical stimulation tool operatively coupled with the isolation mechanism and configured to be disposed distally relative to the isolation mechanism when positioned in the wellbore;

a high-voltage cable coupled to the electrical stimulation tool and configured to deliver electricity to the electrical simulation tool; and a drill pipe, wherein the high voltage cable extends at least partially through the drill pipe.

2. The system of claim 1, further comprising a drill string including a non-conductive distal portion configured to electrically insulate a proximal portion of the drill string from a remainder of the system, and wherein the isolation mechanism and the electrical stimulation tool are operatively coupled to the non-conductive distal portion of the drill string.

3. The system of claim 2, further comprising a high voltage cable, wherein a distal portion of the high voltage cable is configured to pass through a side entry sub of a distal portion of the drill string to enable connection between the high voltage cable and the electrical stimulation tool from within the drill string.

4. The system of claim 2, further comprising a high voltage cable connected to the drill string at spaced apart locations along a length of the drill string.

5. The system of claim 4, wherein the drill string includes a side entry sub through which the high voltage cable is configured to pass.

6. The system of claim 2, further comprising a high voltage cable disposed within at least a portion of the drill string.

7. The system of claim 1, wherein the isolation mechanism is configured to inflate when pressurized.

8. The system of claim 1, wherein the isolation mechanism is made of a degradable material configured to degrade after a predetermined period of time within a wellbore.

9. The system of claim 1, wherein the isolation mechanism is configured to both physically and electrically isolate a lower portion of the wellbore that is downhole from an upper portion of the wellbore.

* * * * *